United States Patent [19]

Carpenter

[11] Patent Number: 5,016,825

[45] Date of Patent: May 21, 1991

[54] GRINDING IMPELLER ASSEMBLY FOR A GRINDER PUMP

[75] Inventor: Roger E. Carpenter, Clearcreek Township, Ashland County, Ohio

[73] Assignee: McNeil (Ohio) Corporation, St. Paul, Minn.

[21] Appl. No.: 480,110

[22] Filed: Feb. 14, 1990

[51] Int. Cl.[5] ..... B02C 18/06

[52] U.S. Cl. ..... 241/46.06; 241/46 B; 241/258; 415/121.1

[58] Field of Search ..... 415/121.1; 241/46.02, 241/46.04, 46.06, 46.08, 258, 242, 185 A, 100.5, 257 G, 46 A, 46 B

[56] References Cited

U.S. PATENT DOCUMENTS

| | | | |
|---|---|---|---|
| 3,194,505 | 7/1965 | Spackman | 241/46.08 X |
| 3,578,250 | 5/1971 | Combs et al. . | |
| 3,650,481 | 3/1972 | Conery et al. . | |
| 3,667,692 | 6/1972 | Grace . | |
| 3,885,745 | 5/1975 | Hankes et al. . | |
| 4,108,386 | 8/1978 | Conery et al. . | |
| 4,141,510 | 2/1979 | Smith . | |
| 4,222,528 | 9/1980 | Smith . | |
| 4,238,079 | 12/1980 | Otto . | |
| 4,378,093 | 3/1983 | Keener . | |
| 4,454,993 | 6/1984 | Shibata et al. . | |
| 4,640,666 | 2/1987 | Sodergard . | |
| 4,697,746 | 10/1987 | Nishimori . | |
| 4,767,069 | 8/1988 | Kim . | |

OTHER PUBLICATIONS

Piranha Grinder Pumps, Bulletin 400.3, by ABS Pumps.

SGV Series Pumps brochure, by Peabody Barnes.

Basic Environment/One Grinder Pump brochure.

Grinder Pumps brochure, by Gorman-Rupp Company, P.O. Box 1217, Mansfield, Ohio 44901, 1982.

Submersible Grinder Pumps Model GL890 specification sheet, by Goulds & Lowara, 1986.

Barracuda Grinder Pumps brochure, by HOMA Pumps.

The Liquidator and HYRO-O-GRIND Pumps brochure, by Hydromatic.

*Primary Examiner*—Mark Rosenbaum

*Attorney, Agent, or Firm*—Renner, Kenner, Greive, Bobak, Taylor & Weber

[57] ABSTRACT

A grinding assembly (10) for a grinder pump (13) has disk member (11) rotatable within an opposing annular ring (12). The inner circumferential surface (34) of the annular ring (12) carries a plurality of cutting teeth (41, 42), which partially extend at an angle along the lateral dimension of the inner circumferential surface (34). Disk member (11) has an annular edge (50) which separates a side (51) distal to the pump inlet (17) and a side (52) proximal to the inlet (17). At least one projection (60) extends from the distal side (51) and has a leading edge (63) facing toward the direction of normal shaft rotation. At least one cutting member (70) extends from the proximal side (52) and also has a leading edge (74). Proximal side (52) has a recess (80) forming first and second cutting edes (82, 84). Similarly, distal side (51) has a recess (90) having first and second cutting edges (93, 94). Proximal recess (80) overlaps distal recess (90) along the width of annular redge (50).

17 Claims, 4 Drawing Sheets

GRINDING IMPELLER ASSEMBLY FOR A GRINDER PUMP

TECHNICAL FIELD

The present invention relates generally to grinder pumps. More particularly, the present invention relates to grinding assemblies for grinder pumps. Specifically, the present invention relates to a grinding impeller assembly having a unique structure and geometry so as to produce more efficient grinding of materials.

BACKGROUND ART

Grinder pumps are commonly known in the art as being useful in grinding large solid or semisolid materials in liquid in order to form a slurry which is more easily disposable than the solids themselves. These pumps often have an axial inlet communicating with a pumping chamber and a motor driven shaft extending through the pumping chamber and into the inlet. The shaft is used to rotate a cutting disk within an annular ring thereby effecting the grinding action of the pump. An example of such a pump is disclosed in U.S. Pat. No. 4,108,386.

It has been found that the configuration of the cutting disk and annular ring are of paramount importance in the efficiency of grinder pumps. Those skilled in the art expend much effort in identifying the configuration of the cutting surfaces which are most efficient for grinding various materials. For instance, U.S. Pat. No. 4,378,093 discloses a grinder pump cutter assembly specifically adapted to be useful in grinding rubber and other elastomeric substances.

Fibers and string materials are known to cause difficulties for grinder pumps. Because these materials present a relatively small cross section, they are not readily engageable by the cutting surfaces. Compounding the problem is that their long length allows them to wrap around the pump parts such as the disk, the annular ring and the pump shaft. It is therefore desirable that a grinding assembly for a grinder pump not only provides efficient grinding of solids or semisolid materials but also has particular application to grinding fibers and string-like materials.

DISCLOSURE OF THE INVENTION

It is therefore, a primary object of the present invention to provide a grinding assembly for a grinder pump which improves the grinding efficiency of the pump.

It is a further object of the present invention to provide a grinding assembly, as above, which decreases clogging at the pump outlet.

It is another object of the present invention to provide a grinding assembly, as above, which has particular abilities to grind fibers and string-like materials.

These and other objects of the present invention, which will become apparent in light of the following specification, are carried out according to the invention hereinafter described and claimed.

In general, the grinding impeller assembly of the present invention is particularly suited to be used in a grinder pump which has an axial inlet, a pumping chamber communicating therewith, and a rotatable shaft extending through the chamber. The impeller assembly includes a disk member which rotates within an opposing annular ring positioned within the inlet. The disk member rotates with the shaft and has an outer annular edge, a side distal to the inlet, and a side proximal thereto. The distal and proximal sides are separated by the outer annular edge of the disk member. At least one projection extends axially from the distal side of the disk member and at least one cutting member extends from its proximal side. Both the distal side and the proximal side have a recess extending generally radially inward of the disk member. The annular ring has a first and second edge separated by an inner and an outer circumferential surface. A plurality of cutting slots are provided on the inner circumferential surface of the annular ring.

PREFERRED EMBODIMENT FOR CARRYING OUT THE INVENTION

Figure 1:
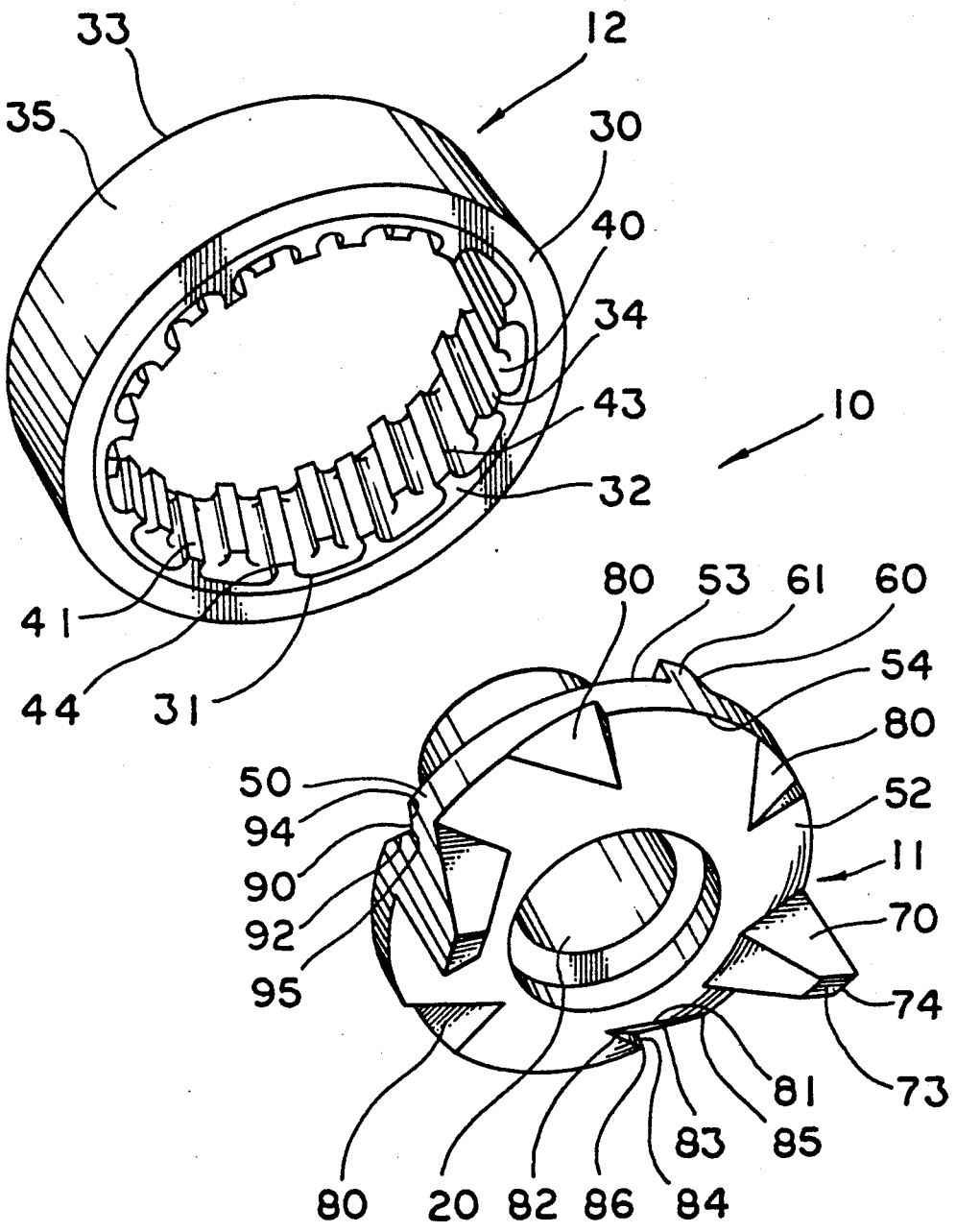
FIG. 1 is an exploded, perspective view of a grinding impeller assembly for a grinder pump according to the concepts of the present invention and shown as having a disk member portion and an annular ring portion.

A grinding impeller assembly according to the present invention is generally indicated by the numeral 10 in the drawings. As best shown in FIG. 1, grinding impeller assembly 10 includes a disk member portion generally indicated by the numeral 11 and an annular ring portion generally indicated by the numeral 12.

Figure 2:
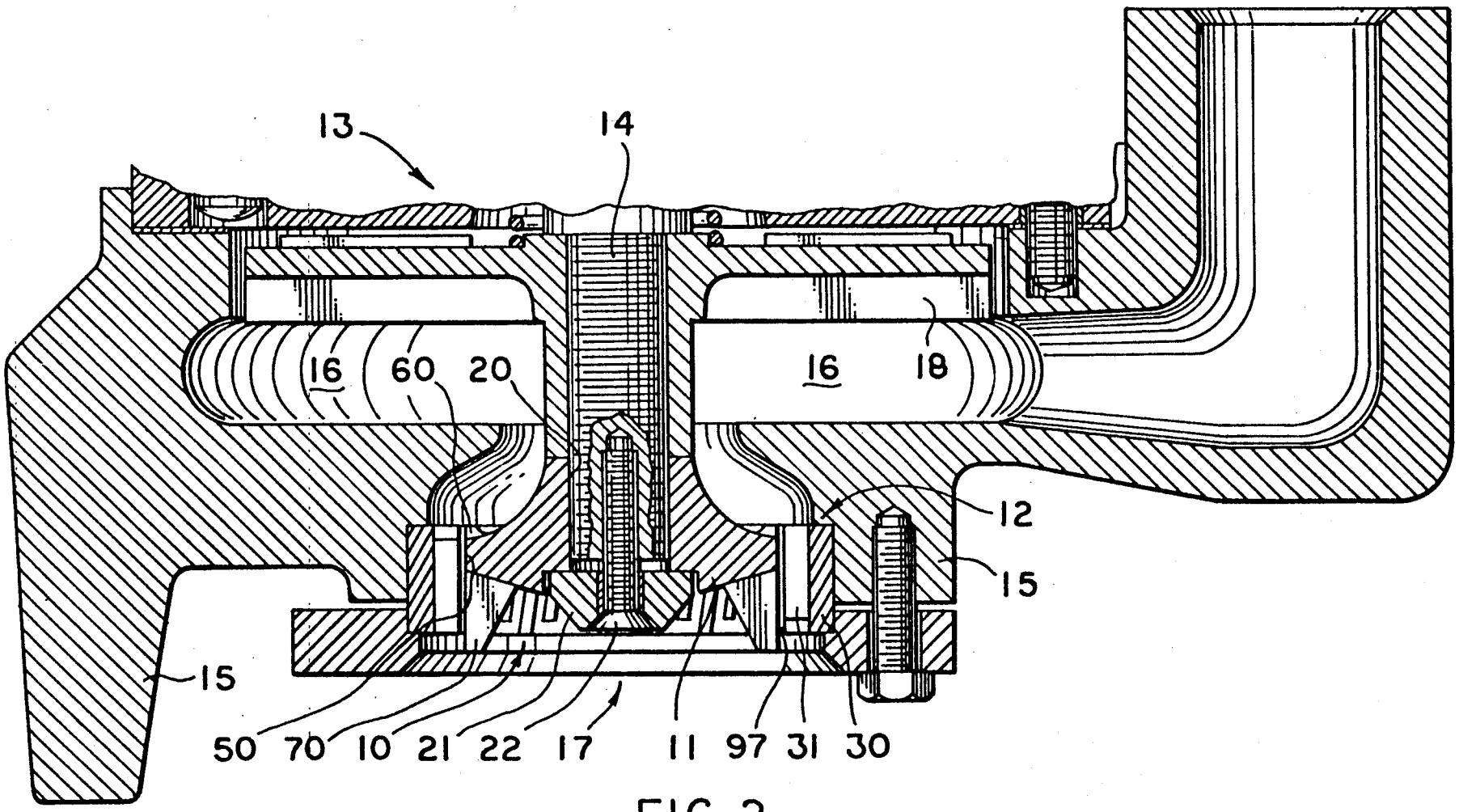
FIG. 2 is a partial elevational view and partially vertically sectioned view of the grinder impeller assembly of FIG. 1, shown in the environment of a grinder pump with portions of the pump partially broken away.

A grinder pump is generally indicated by the numeral 13 in FIG. 2 and includes a rotatable shaft 14 driven by a pump motor (not shown), so as to normally rotate shaft 14 in a single direction. A volute pump casing 15 defines a pumping chamber 16. Pumping chamber 16 communicates with an axial inlet generally indicated by the numeral 17. Although not a limitation of the present invention, it is known in the art to provide grinder pumps, such as pump 13, with a fluid impeller 18. Fluid impeller 18 is affixed to and rotates with shaft 14 so as to draw fluids and materials through axial inlet 17 and into pumping chamber 16.

As shown in FIG. 2, grinding impeller assembly 10 is positioned at the lower end of pumping chamber 16 and adjacent to axial inlet 17. Any fluid and material drawn through axial inlet 17 must pass through grinding impeller assembly 10 as it enters pumping chamber 16.

Pump shaft 14 extends into pumping chamber 16 and disk member 11 is provided with a receiving aperture 20, such that one end of shaft 14 may be received therein. A washer 21 and a bolt 22 may be provided in order to secure disk member 11 to shaft 14 such that disk member 11 will rotate with shaft 14. It is to be appreciated by one skilled in the art that the securing engagement of disk member 11 and shaft 14 may be accomplished in numerous ways, of which washer 21 and bolt 22 are only an example. Further examples might include a securing engagement by adhesive bonding or by integrally forming shaft 14 and disk member 11. All such securing engagements are within the scope of the present invention.

Disk member 11 is axially positioned within annular ring 12. Annular ring 12 may be affixed in any conventional manner to volute casing 15. When disk member 11 rotates with shaft 14, it thus rotates within the stationary annular ring 12. It is the rotation of disk member 11 within opposing annular ring 12 which provides the grinding action to the pump, as will be more fully discussed below.

Annular ring 12 may include an outer ring housing 30, the outside of which is affixed to casing 15, and an inner cutting ring 31 integral with ring housing 30. Ring 12 has a first edge 32 and a second edge 33 which lie in respective planes which are preferably parallel. Axially separating first and second edges 32 and 33 are an inner and an outer circumferential surface 34 and 35, respectively.

Figure 3:
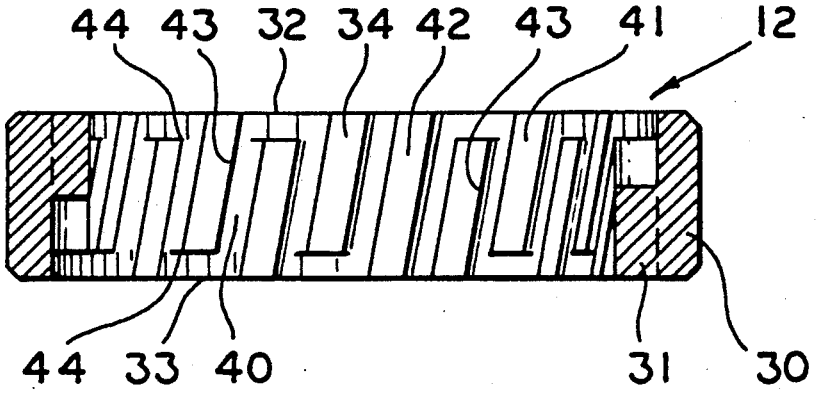
FIG. 3 is a sectional view of the annular ring portion of the grinding impeller assembly of FIG. 1.

Inner surface 34 includes a plurality of slots 40 which have a semi-circular cross section as is shown in FIG. 1. Slots 40 extend from first edge 32 to second edge 33. The intersection of slots 40 and inner circumferential surface 34 creates cutting teeth 41. Each tooth 41 extends from either first or second edge 32 or 33, to some distance short of the opposite such edge. Preferably, teeth 41 alternate in configuration. That is, a tooth 41 extends from first edge 32 to some distance short of second edge 33, the next tooth 41 extends from second edge 33 to some distance short of first edge 32, and so on around the circumference of inner circumferential surface 34. Since there is an odd number of teeth on the ring, one tooth indicated by the numeral 42 (FIG. 3) extends completely from first edge 32 to second edge 33 so that there is not one large space between teeth that would result if it were not for full length tooth 42.

Teeth 41 have cutting edges 43 and cutting corners 44. Because of the alternating length of teeth 41, cutting corners 44 are at alternating positions. It has been found that this configuration improves the cutting interaction between disk member 11 and annular ring 12.

Slots 40 and teeth 41, 42 are also shown as being angled from a line perpendicular to the planes of first and second edges 32 and 33. It has been found that when slots 40 and teeth 41, 42 have a lateral dimension forming an angle of approximately 10 degrees from the perpendicular, there is a substantial improvement in the cutting of solid or semisolid materials due to an increased scissor-like cutting action between teeth 41, 42 and disk member 11. When disk member 11 rotates within annular ring 12, solid materials are caused to move in a direction from inlet 17 to pumping chamber 16. As such, the plurality of alternating slots 40 and teeth 41, 42 operate in a fashion somewhat similar to screw threads due to the angles thereof, providing a force urging the solid materials in a direction toward pumping chamber 16. This serves to increase the action of grinder pump 13 in grinding and removing solid materials from a fluid flow, as well as to reduce clogging of materials between disk member 11 and annular ring 12.

Because of the symmetry of the configuration of annular ring 12, it may be placed with either first or second edge 32 or 33 being proximal to inlet 17, and with the other end distal thereto within pumping chamber 16. If annular ring 12 is placed in the orientation with first edge 32 proximal to inlet 17 and if cutting edges 43 or cutting corners 44 become dulled with extended use, annular ring 12 may simply be turned over such that second edge 33 is proximal to inlet 17. This will provide a fresh cutting edge 43 and cutting corner 44 to properly engage and cut solid materials.

As best shown in FIGS. 1 and 4–6, disk member 11 includes an outer annular edge 50, and when secured to shaft 14 as described above, disk member 11 has a side 51 distal to axial inlet 17 and a side 52 proximal thereto. Annular edge 50 separates distal side 51 and proximal side 52 with the intersection between annular edge 50 and distal side 51 forming a line 53, and the intersection between annular edge 50 and proximal side 52 forming a line 54. Lines 53 and 54 are shown as being preferably parallel.

Figure 4:
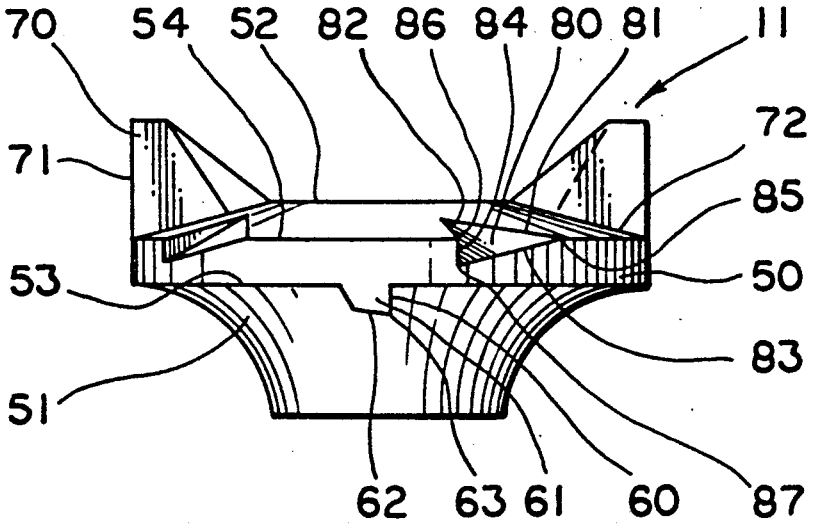
FIG. 4 is a side elevational view of the disk member portion of the grinding impeller assembly of FIG. 1.
Figure 5:
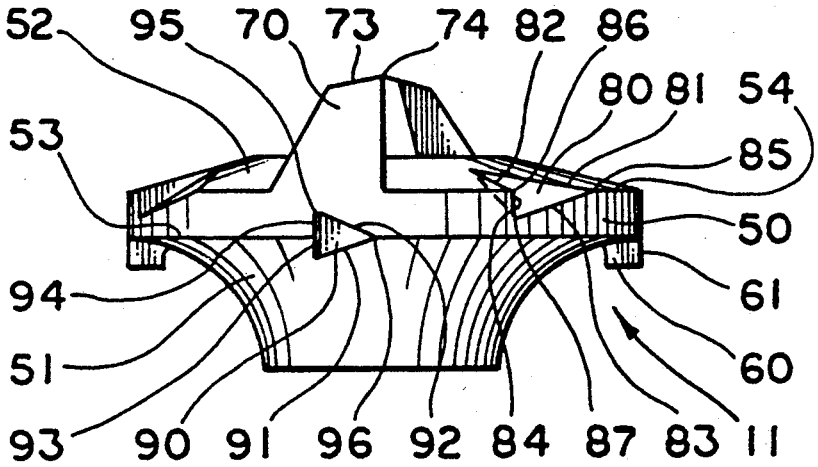
FIG. 5 is another side elevational view of the disk member portion of the grinding impeller assembly of FIG. 1 rotated 90 degrees from the view of the disk member portion shown in FIG. 4.

Distal side 51 has at least one and preferably two projections 60 extending generally axially therefrom and toward pumping chamber 16 to a distance short of fluid impeller 18, and generally coincident with the upper edge 32 or 33 of annular ring 12. Preferably, each projection 60 has at least one side wall 61 which is flush with annular edge 50, as best shown in FIG. 5, and an upper terminating surface 62 (FIG. 4). It has been found to be beneficial to angle terminating surface 62 in relation to the direction of normal shaft rotation. Thus, as shown in FIG. 4, the embodiment of the invention as depicted therein has an angle of approximately 20 degrees between terminating surface 62 and line of intersection 53, and 20 degrees from the radius of disk member 11. This provides a leading edge 63 to each projection 60 which, because of the acute angle, exhibits a greater cutting action. Distal projections 60 force any uncut fibers of string like material against slots 40 of the opposing inner circumferential surface 34 of rings 12 ensuring that such materials are cut.

Proximal side 52 of disk member 11 has at least one and preferably two main cutting members 70 extending generally axially therefrom. Each cutting member 70 preferably has a side wall 71 flush with annular edge 50 of disk member 11 and a base 72 which is formed by the intersection of each cutting member 70 and proximal side 52 of disk member 11. Each cutting member 70 axially terminates at a surface 73 which is angled in relation to the direction of normal shaft rotation, forming a draft angle with line of intersection 54 as best shown in FIG. 5. Somewhat similar to the angle of terminating surface 62 of distal projection 60, the existence of this angle of terminating surface 73 of cutting member 70 has been found to dramatically increase grinding efficiency. A draft angle of approximately 10 degrees has been found to result in a sharper leading edge 74 for improved initial tearing of waste materials.

Figure 6:
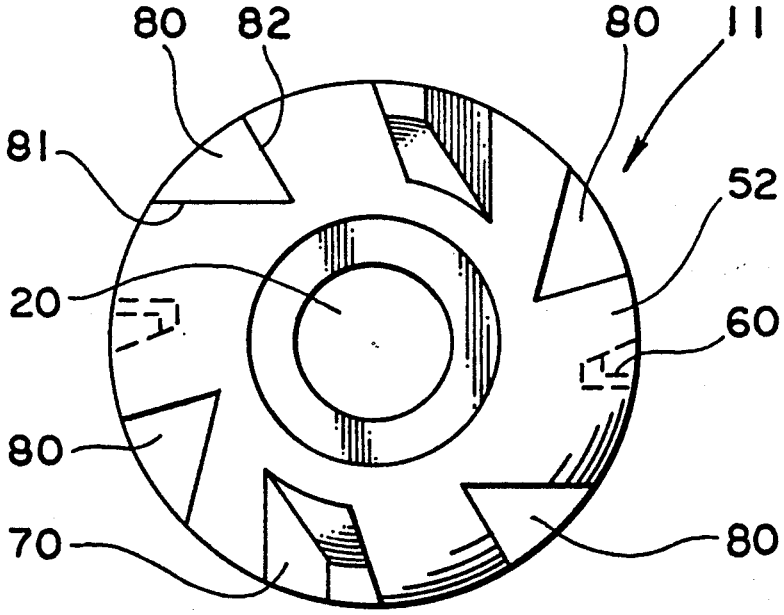
FIG. 6 is a bottom plan view of the disk member portion of the grinding impeller assembly of FIG. 1.

Disk member 11 is also provided with at least one and preferably four recesses 80 on proximal side 52, wherein each recess 80 extends somewhat radially inward and axially upward of disk member 11 (FIGS. 4–6). Each recess 80 intersects proximal side 52 forminq a first shoulder 81 and a first cutting edge 82. Recesses 80 also extend to annular edge 50, intersecting annular edge 50 to form a second shoulder 83 and a second cutting edge 84. First and second shoulders 81 and 83 intersect on line of intersection 54 at point 85. Similarly, first and second cutting edges 82 and 84 intersect on line of intersection 54 at point 86. First and second cutting edges 82 and 84 form another scissor-like surface which may engage and tear or shred solid materials. Second cutting edge 84 of each proximal recess 80 intersects second shoulder of proximal recess 80 at point 87, which is positioned between lines of intersection 53 and 54.

Distal side 51 of disk member 11 is also provided with at least one and preferably two recesses 90 extending somewhat radially inwardly and axially downwardly of disk member 11 (FIG. 5). As with the proximal recesses 80, each distal recess 90 has a first shoulder 91 intersecting distal side 51 and a second shoulder 92 intersecting annular edge 50. Further, a first cutting edge 93 intersects distal side 51 and a second cutting edge 94 intersects annular edge 50. Second cutting edge 94 of distal recess 90 intersects second shoulder 92 of distal recess 90 at a point 95, between first and second lines of intersection 53 and 54. First shoulder 91 intersects second shoulder 92 on line of intersection 53 at point 96. In the preferred embodiment of the impeller assembly 10, point 87 of proximal recess 80 overlaps point 95 of distal recess 90 along the width of the circumference of annular edge 50. By overlapping point 87 of the proximal recess 80 and point 95 of distal recess 90, there is no continuous 360 degree surface area around annular edge 50. Waste materials are trapped and cut by first and second cutting edges 82 and 84 of proximal recess 80, as well as first and second cutting edges 93 and 94 of distal recess 90. It has been found that this configuration prevents string-like materials from jamming between disk member 11 and annular ring 12 thereby ensuring that such string materials are cut. It has also been found that improved cutting action is achieved by off-setting first and second shoulders 91, 92 by approximately three-eighths of an inch from and parallel to a radial line through disk member 11. The intersection of first cutting shoulder 91 and first cutting edge 93 thus forms an angle of approximately 50 degrees.

As best shown in FIG. 2, disk member 11 is dimensioned such that a gap 97 is present between annular edge 50 and inner circumferential surface 34 of ring 12. Gap 97 allows room for disk member 11 to rotate without directly contacting static annular ring 12.

Because side wall 61 of distal side projection 60 is flush with annular edge 50, it shreds waste materials in conjunction with teeth 41, 42 of annular ring 12. Similarly, side wall 71 of cutting member 70 shreds in conjunction with teeth 41, 42 of annular ring 12.

Thus it should be evident that a grinding assembly for a grinder pump achieving the objects of the present invention and otherwise being an advantageous contribution to the art is accomplished by the device disclosed herein and claimed as follows.

I claim:

1. A grinding impeller assembly for a grinder pump having an axial inlet, a pumping chamber communicating with the axial inlet, a rotatable shaft extending axially through said chamber and normally rotating in a single direction, the grinding impeller assembly comprising a disk member carried by and rotatable with the shaft; an annular ring positioned generally within the axial inlet and around said disk member; said disk member having an outer annular edge, a side distal to the inlet and a side proximal to the inlet; said distal and proximal sides being separated by said annular edge of said disk member; said distal side of said disk member having at least one projection extending generally axially from said disk member; said proximal side of said disk member having at least one cutting member extending generally axially from said disk member; said distal and proximal sides each having at least one recess therein extending generally radially inward of said disk member; said annular ring having a first edge, a second edge, and an inner circumferential surface facing said disk member; said inner circumferential surface axially separating said first and second edges and carrying a plurality of cutting teeth; said cutting teeth extending from said first or second edges of said annular ring.

2. A grinding impeller assembly as in claim 1, wherein said at least one projection extending generally axially from said distal side of said disk member has a leading edge facing toward the direction of normal shaft rotation.

3. A grinding impeller assembly as in claim 2, wherein said leading edge is angled at least 20 degrees from the radius of said disk member.

4. A grinding impeller assembly as in claim 1, wherein said recess of said distal side overlaps said recess of said proximal side along the width of said annular edge of said disk member.

5. A grinding impeller assembly as in claim 1, wherein said cutting member of said proximal side has a base integrally formed with said proximal side of said disk member, and a terminating surface opposite said base.

6. A grinding impeller assembly as in claim 5, wherein said terminating surface of said cutting member is angled in relation to said base in a direction away from the direction of normal shaft rotation, forming a draft angle.

7. A grinding impeller assembly as in claim 6, wherein said draft angle is approximately 10 degrees.

8. A grinding impeller assembly as in claim 1, wherein said recess of said distal side is formed from a first and second shoulder and a first and second cutting edge.

9. A grinding impeller assembly as in claim 8, wherein said first and second shoulders intersect at said annular edge of said disk member.

10. A grinding impeller assembly as in claim 9, wherein said first and second cutting edges of said distal recess intersect at said annular edge of said disk member.

11. A grinding impeller assembly as in claim 8, wherein said first shoulder extends from said distal side of said disk member and said second shoulder extends from said annular edge of said disk member.

12. A grinding impeller assembly as in claim 11, wherein said first shoulder of said distal recess forms an angle of approximately 50 degrees with said first cutting edge.

13. A grinding impeller assembly as in claim 12, wherein said first shoulder and second shoulders are offset by approximately three-eighths of an inch from and parallel to a radial line of said disk member.

14. A grinding impeller assembly for a grinder pump having an axial inlet, a pumping chamber communicating with the axial inlet, a rotatable shaft extending axially through said chamber and normally rotating in a single direction, the grinding impeller assembly comprising a disk member carried by and rotatable with the shaft, an annular ring positioned generally within the axial inlet around said disk member; said annular ring having a first edge, a second edge, and an inner circumferential surface facing said disk member; said inner circumferential surface axially separating said first and second edges and carrying a plurality of cutting teeth; said cutting teeth having a lateral dimension which is angled from a line perpendicular to the planes of said first and second edges of said annular ring; and said cutting teeth extending from said first or said second edge, and terminating some distance short of the opposite said edge.

15. A grinding impeller assembly as in claim 14, wherein said angle of said lateral dimension of said cutting teeth is approximately 10 degrees.

16. A grinding impeller assembly as in claim 14, wherein said inner circumferential surface also carries a plurality of cutting slots alternately extending from said first edge and from said second edge of said annular ring in repetition around said inner circumferential surface.

17. A grinding impeller assembly as in claim 16, wherein at least one of said cutting slots completely extends from said first edge to said second edge of said annular ring.

* * * * *